US005136726A

United States Patent [19]

Kellin et al.

[11] Patent Number: 5,136,726

[45] Date of Patent: Aug. 11, 1992

[54] STRETCHABLE ARTICLES OF APPAREL WITH DETACHABLE DECORATIVE ELEMENTS

[76] Inventors: Elizabeth Kellin; Dana Kellin, both of 11086 Sunset Blvd., Los Angeles, Calif. 90049

[21] Appl. No.: 680,113

[22] Filed: Apr. 3, 1991

[51] Int. Cl.[5] ..... A41D 27/08

[52] U.S. Cl. ..... 2/244; 2/115; 2/171; 2/196; 2/195; 2/199; 2/311; 2/338; 2/310; 2/DIG. 6

[58] Field of Search ..... 2/244, 115, 171, 196, 2/195, 199, DIG. 6, 311, 338, 310; 66/195; 36/100, 136

[56] References Cited

U.S. PATENT DOCUMENTS

| | | | |
|---|---|---|---|
| 3,484,974 | 12/1969 | Culmone | 2/DIG. 6 |
| 3,596,291 | 8/1971 | Thill | 2/245 |
| 4,249,268 | 2/1981 | Berler | 2/115 |
| 4,610,102 | 9/1986 | Hill | 2/DIG. 6 |
| 4,677,011 | 6/1987 | Matsuda | 66/194 |
| 4,776,043 | 11/1988 | Coleman | 2/DIG. 6 |
| 4,847,917 | 7/1989 | Strongwater | 2/160 |
| 4,873,726 | 10/1989 | Tapia | 2/DIG. 6 |
| 4,918,758 | 4/1990 | Rendina | 2/199 |
| 5,016,285 | 5/1991 | Just | 2/244 |

*Primary Examiner*—Werner H. Schroeder
*Assistant Examiner*—Gloria Hale
*Attorney, Agent, or Firm*—Fleit, Jacobson, Cohn, Price, Holman & Stern

[57] ABSTRACT

An article of apparel having one or more detachable decorative elements replaceably coupled thereto, the article of apparel having substantially all exposed cloth surfaces made of a stretchable material having a multiplicity of loop elements, the detachable decorative elements having a multiplicity of hook elements engaging the loop elements of the material.

8 Claims, 2 Drawing Sheets

STRETCHABLE ARTICLES OF APPAREL WITH DETACHABLE DECORATIVE ELEMENTS

FIELD OF THE INVENTION

The present invention relates to an article of apparel having one or more detachable decorative elements replaceably coupled thereto in a wide variety of possible configurations. The article of apparel has substantially all exposed cloth surfaces made of a stretchable material having a multiplicity of loop elements. To couple the decorative elements to the article of apparel, the detachable decorative elements have a multiplicity of hook elements adapted to engage the loop elements of the stretchable material.

BACKGROUND OF THE INVENTION

Fueled by the current societal emphasis on individuality, today's fashion industry is marked by a growing demand for unique, personalized or designer goods. Regardless of the demand for such goods, present economic realities prevent most consumers from acquiring these typically expensive luxuries. Consumers have shied away from the costly designer clothes market and have turned to the practice of being more creative with the clothes they already own.

The children's clothing industry has not been isolated from current trends. Somewhat more pronounced than as seen in adults, today's children are characterized by a heightened fashion self-consciousness. In this light, increasingly greater demands are being made for articles of apparel that are unique or personal. However, due to the costs involved, and often exacerbated by the inherent fickleness of children, parents are often unwilling or unable to purchase new articles of clothing on the demands of their children every time an old article of clothing goes out of style.

Prior patents have disclosed garments having removable ornamentations. Nonetheless, these past patents have had several shortcomings.

In U.S. Pat. No. 3,484,974 (Culmone), there is disclosed a garment with an elongated flexible strip having fine loops on its outer surface upon which may be attached removable identifying characters. The characters have a plurality of hooking elements on their rear surface which detachably engage the loops of the strip, so that characters were removably secured to the shirt. The primary problem with the Culmone patent is that, as disclosed, the ornaments, i.e. the characters, were not directly coupled to the garment, i.e. the shirt. Instead, the ornaments were replaceably attached to an intermediary strip, and the intermediary strip was permanently attached to the garment. In this light, the problem is clear. The intermediary strip formed a layer sitting atop the garment layer that would be unsightly unless coupled with ornamentation. Without such ornamentation, the garment would be seen as having an indistinct, seemingly purposeless, strip across its torso. Such a limitation is inconsistent with the goals of the present invention.

In U.S. Pat. No. 4,249,268 (Berler), there is disclosed a garment consisting essentially of sections of a fabric having a plurality of loop elements on its outer surface upon which ornaments may be removably attached and strips of stretchable fabric joining the various sections of the looped fabric. The garment includes a neck opening adapted for insertion of a wearer's head when the garment is donned, and a portion surrounding the neck opening is formed of a stretchable fabric to permit the wearer's head to pass through the neck opening in the case when the neck opening is smaller than the wearer's head.

Although the Berler patent overcomes the limitations of the Culmone patent by providing a garment wherein the ornaments are directly attached to the garment itself, Berler nevertheless retains other significant limitations. The problem with the Berler patent derives principally from two interrelated factors. First, the looped material upon which ornaments are attached is made of an inelastic material. Second, due to the inelasticity of the looped material, the garment had to be made by dual incorporation of another elastic material in order for the garment to be easily and comfortably put on and worn. The end result was a garment that was not only inelastic in certain areas but was also heterogeneously made of two different materials each having different properties. Apart from aesthetic problems, the heterogeneity of the garment results in certain practical problems. First, since two materials were used, manufacture of the garment was relatively more difficult. Not only is more stitching required to manufacture the garment, but moreover, due to their different properties, a certain degree of dimensional stabilization of the materials was inherently required to prevent one material from shrinking or wearing faster than the other. Additionally, the relatively greater number of seams also decreases the strength of the garment as a whole. Second, since two materials were used, only one of which could be coupled with ornamentation, the consumer's freedom in positioning ornaments was restricted only to certain areas. As with the Culmone patent, the limitations of the Berler patent are incompatible with the goals of the present invention.

SUMMARY OF THE PRESENT INVENTION

The present invention is directed to offering a degree of relief to the problem described above by providing articles of apparel, such as shoes, backpacks, hats, and suspenders, the exposed cloth surfaces of which are made of a stretchable material capable of having removably attached to it a wide variety of detachable decorations. Such articles would allow a wide latitude of personalized decorative design and composition by the consumer in accordance with the consumer's own individual tastes. The consumer may decorate the article in one fashion on one occasion and, with ease, redecorate the article in another fashion on another occasion. Thus, while buying only one article and a few decorative attachments, the consumer can achieve a wide array of styles. This will reduce the costs to the consumer while satiating the consumer's desire for personalized articles of apparel.

The present invention overcomes the problems associated with the Berler patent by providing an article of apparel wherein detachable decorative elements are replaceable coupled to a stretchable material. Unlike the Berler patent, substantially all exposed cloth surfaces of the article of apparel are made of the stretchable loop fabric. In this manner the aesthetic and functional problems associated with the dual use of heterogenous fabrics is eliminated. Moreover, since substantially all exposed cloth surfaces of the article of apparel are made of the stretchable looped material, the consumer is given a much greater degree of freedom in positioning the detachable decorative elements. Such an end is wholly consistent with the objectives of the present invention.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
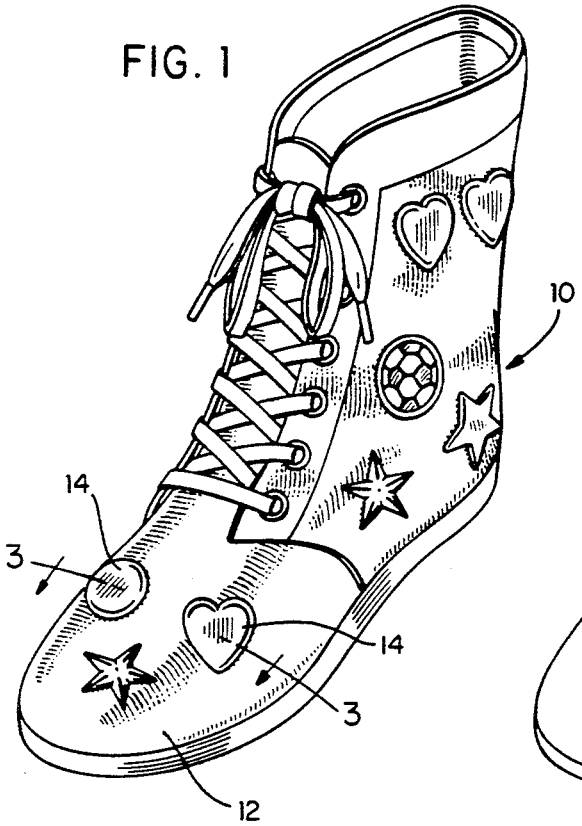
FIG. 1 shows a view of the invention in the embodiment of a sneaker.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As seen in FIG. 1, the present invention, "STRETCHABLE ARTICLES OF APPAREL WITH DETACHABLE DECORATIVE ELEMENTS", is an article of apparel, in this instance a sneaker 10, made of a fabric 12 upon which may be detachably coupled a number of various detachable decorative elements 14.

Figure 3:
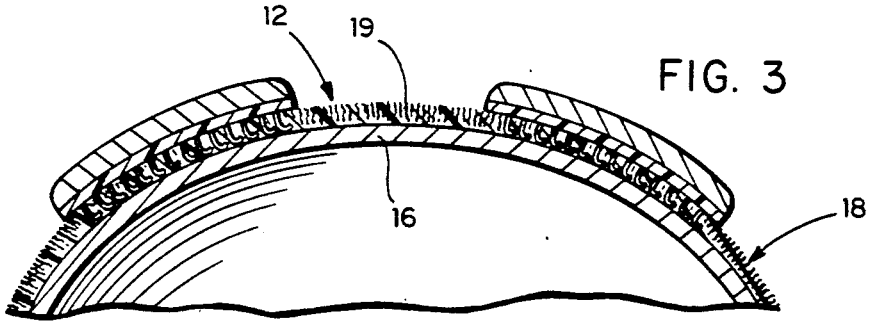
FIG. 3 shows a cross-sectional view along line 3—3 of FIG. 1 at a decorative attachment coupling area.
Figure 5:
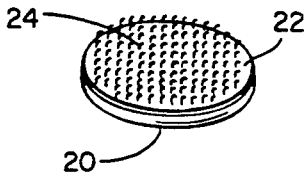
FIG. 5 shows a detailed view of the attachment side of a decorative attachment.

As seen in FIG. 3, the fabric 12 has two surface layers. A stretchable inner surface layer 16 is made of a material having elastic properties. An outer surface layer 18 includes a looped surface 19, integrally united with the stretchable inner surface layer 16. Also as seen in FIG. 3, and in a different perspective in FIG. 5, a decorative element 14 has a decorative element surface 20, a decorative element base 22, and a multiplicity of hook elements 24. As with the stretchable inner surface layer 16, the decorative element base 22 is made of a material having elastic properties. The hook elements 24, integrally united with the decorative attachment base 22, are designed so as to hook on to and attach to the looped surface 19 of the outer surface layer 18. To this end, the looped surface 19 is comprised of a multiplicity of loops designed so as to catch the hook elements 24 of decorative element 14.

Figure 2:
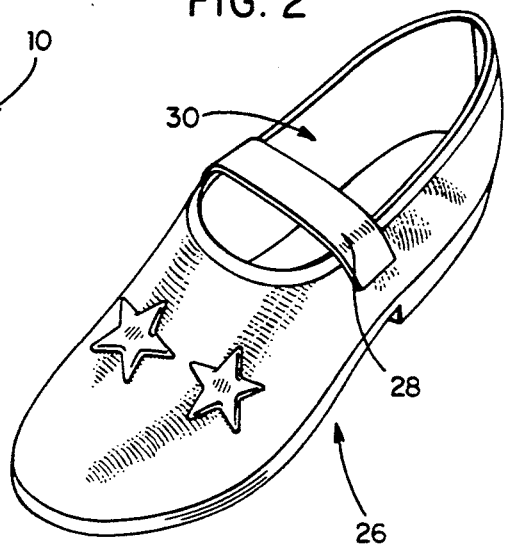
FIG. 2 shows a view of the invention in the embodiment of a slipper.
Figure 4:
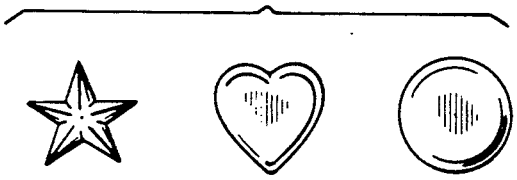
FIG. 4 shows examples of decorative attachments.

A wide spectrum of detachable decorative elements 14 are available for coupling onto the exposed fabric 12 of the article of apparel in the manner described above. FIG. 4, as well as FIGS. 1, 2, 6, 7, 8, and 9 display examples of both the variety of detachable decorative elements 14 as well as the diverse arrangement potential of such elements. In the embodiment of FIG. 2, the article of apparel is a slipper 26, with a detachable decorative attachment in the configuration of a strap 28 positionable over the foot entrance 30 of the slipper. By altering the position of the strap 28, or by omitting it altogether, one may change the style of the slipper.

Figure 6:
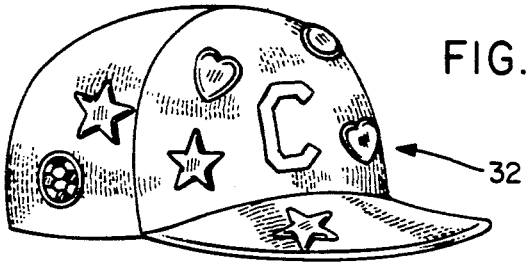
FIG. 6 shows a view of the invention in the embodiment of a baseball cap.
Figure 7:
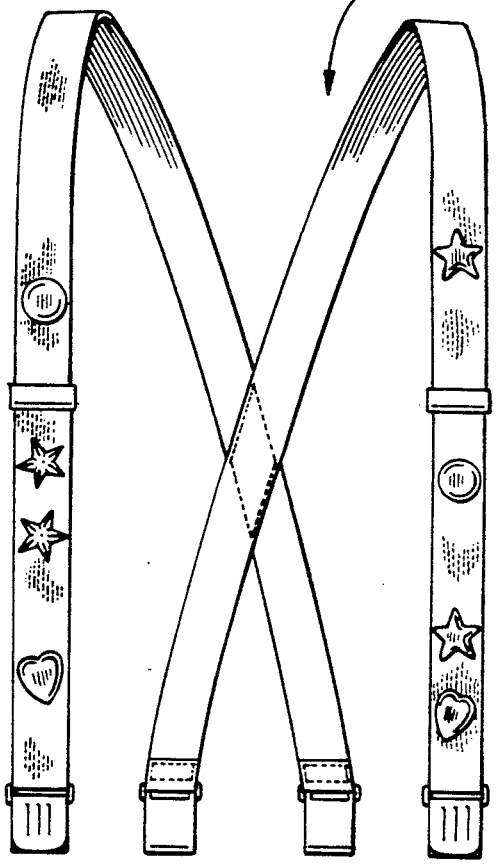
FIG. 7 shows a view of the invention in the embodiment of a pair of suspenders.
Figure 8:
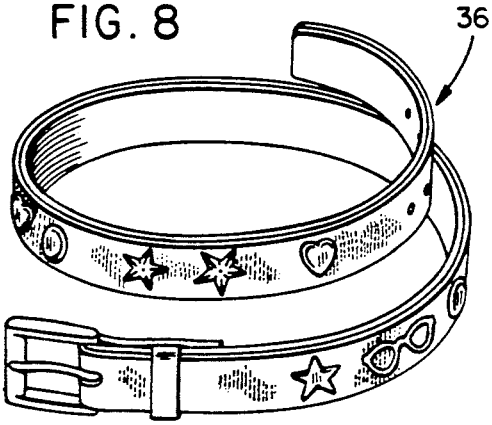
FIG. 8 shows a view of the invention in the embodiment of a belt.
Figure 9:
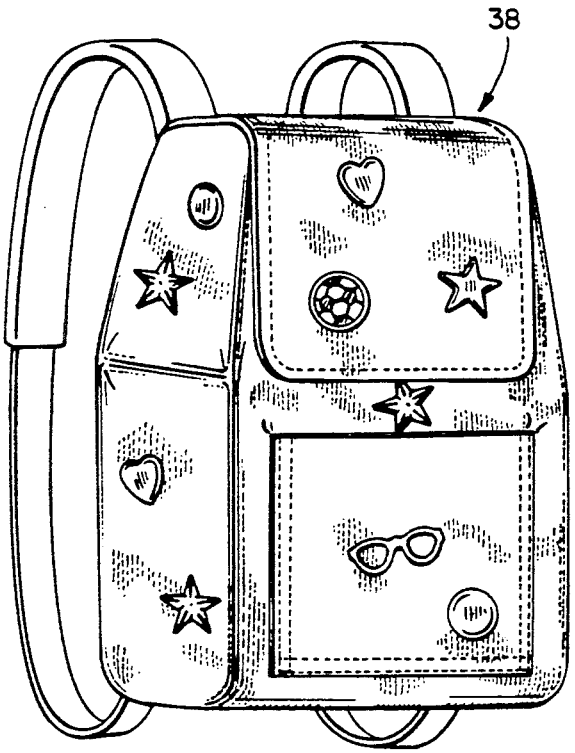
FIG. 9 shows a view of the invention in the embodiment of a backpack.

Although the article of apparel illustrated in FIG. 1 is a sneaker, the present invention is not limited to that particular article of apparel. FIG. 2 illustrates an embodiment of the invention where the article of apparel is a slipper 26. FIG. 6 illustrates an embodiment of the invention where the article of apparel is a baseball cap 32. In FIG. 7, the article of apparel is embodied as pair of suspenders 34. And, in FIG. 8 and FIG. 9, the article of apparel is embodied as a belt 36 and backpack 38, respectively.

Although the invention has been described with relation to certain preferred embodiments, it is contemplated that those skilled in the art may make changes to certain features of the preferred embodiment without altering the overall basic function and concept of the invention and without departing from the spirit and the scope of invention as defined in the appended claims.

We claim:

1. In combination, an article of clothing and at least one detachable decorative element, said article of clothing having substantially all exposed cloth surfaces made of a flexible material having a multiplicity of loop elements, said detachable decorative elements having a multiplicity of hook elements engaging said loop elements of said article of clothing for random positioning of said at least one detachable decorative element anywhere on said article of clothing.

2. The invention as claimed in claim 1, wherein said article of apparel is a shoe.

3. The invention as claimed in claim 2, wherein said shoe is a slipper, said slipper having a foot entrance and wherein a detachable decorative element is a strap positionable across said foot entrance.

4. The invention as claimed in claim 1, wherein said article of apparel is a cap.

5. The invention as claimed in claim 1, wherein said article of apparel is a belt.

6. The invention as claimed in claim 1, wherein said article of apparel is a suspender.

7. In combination, an article carried by an individual and at least one detachable decorative element, said article having substantially all exposed cloth surfaces made of a flexible material having a multiplicity of loop elements, said detachable decorative elements having a multiplicity of hook elements engaging said loop elements of said article for random positioning of said at least one detachable decorative element anywhere on said article.

8. The invention as claimed in claim 7, wherein said article is a backpack.

* * * * *